United States Patent [19]

Hundertmark

[11] Patent Number: 4,776,303

[45] Date of Patent: Oct. 11, 1988

[54] TWO CYCLE ENGINE WITH CYLINDER LINER AND EXHAUST BRIDGE LUBRICATION AND COOLING

[75] Inventor: James M. Hundertmark, Fond du Lac, Wis.

[73] Assignee: Brunswick Corporation, Skokie, Ill.

[21] Appl. No.: 133,314

[22] Filed: Dec. 16, 1987

[51] Int. Cl.[4] ..... F02F 1/10

[52] U.S. Cl. ..... 123/41.84; 123/73 PP; 123/668

[58] Field of Search ..... 123/73 PP, 543, 546, 123/668, 41.33, 41.3, 41.39, 41.79, 41.78, 41.84

[56] References Cited

U.S. PATENT DOCUMENTS

| | | | |
|---|---|---|---|
| 2,085,810 | 7/1937 | Ljungstrom | 123/41.32 |
| 3,127,879 | 4/1964 | Giacosa et al. | 123/41.08 |
| 3,687,232 | 8/1972 | Stenger | 184/6.8 |
| 3,714,931 | 2/1973 | Neitz et al. | 123/41.79 |
| 3,881,454 | 5/1975 | Jaulmes | 123/73 PP |
| 4,348,991 | 9/1982 | Stang et al. | 123/41.44 |
| 4,440,118 | 4/1984 | Stang et al. | 123/41.84 |
| 4,557,227 | 12/1985 | Woodard | 123/65 PE |

*Primary Examiner*—Charles J. Myhre
*Assistant Examiner*—David A. Okonsky
*Attorney, Agent, or Firm*—Andrus, Sceales, Starke & Sawall

[57] ABSTRACT

In a two cycle internal combustion engine (2) having a cylinder liner (14), a fuel-air flow passage (52) is provided from the crankcase (8) to the exhaust bridge (38) in the cylinder liner (14) and the exhaust bridge (39) in the cylinder block (12) along the interface between the cylinder liner (14) and the cylinder block (12). A plurality of apertures (57–60) are provided through the cylinder liner (14) communicating with the fuel-air flow passage (52). A second fuel-air flow passage (56) is provided between the piston (4) and the cylinder liner (14) and in communication with the apertures (57–60) to facilitate fuel-air mixture flow through the exhaust bridge (38) to improve lubrication and cooling thereof.

12 Claims, 2 Drawing Sheets

TWO CYCLE ENGINE WITH CYLINDER LINER AND EXHAUST BRIDGE LUBRICATION AND COOLING

BACKGROUND AND SUMMARY

The invention relates to two cycle engines having a cylinder liner with an exhaust bridge.

In a two cycle internal combustion engine, it is known to provide an exhaust port with two openings through the cylinder liner and cylinder wall, and with a bridge between the openings to prevent expansion of the piston rings into the exhaust port. However, when the bridge becomes heated it may expand into the cylinder which in turn interfers with the piston and causes heavy loading of the piston. One solution known in the prior art is to relieve the bridge. The present invention provides another solution where it is undesirable to relieve the bridge in a cylinder liner.

In two cycle engines with cylinder liners and exhaust bridges, another recurring problem is how to cool and lubricate the bridge. It is known in the prior art to provide a series of holes in the piston in the area where the piston runs on the exhaust bridge to help lubricate that area of the cylinder liner. However, the problem of cooling the exhaust bridge still remains.

The present invention uses fresh incoming fuel-air charge to lubricate and cool the exhaust bridge when the piston is on the downward stroke. In the preferred embodiment, a slot is cut in the outer diameter of the cylinder sleeve liner. The slot runs up the back side of the exhaust bridge of the cylinder liner. The bridge has a series of holes drilled therethrough into the cylinder. The piston has a relieved flat surface machined on its outer side wall in the area of the bridge such that on the downward power stroke of the piston the holes in the bridge are not closed off. The slot in the liner communicates with the crankcase so that when the crankcase is pressurized during the downward power stroke of the piston, fuel-air mixture is forced up the backside of the bridge and out through the holes to cool and lubricate the bridge. In an alternative, the slot is machined in the block before the liner is installed. A check valve may be used in the slot to ensure flow only in the desired direction in the slot.

DETAILED DESCRIPTION

Figure 1:
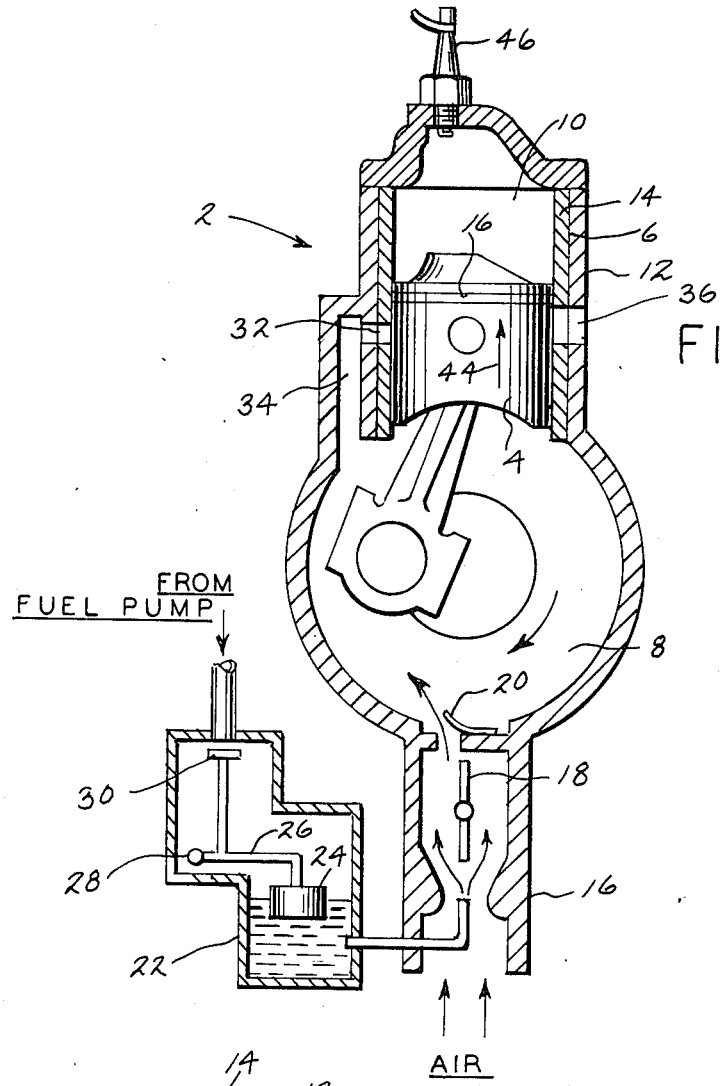
FIG. 1 is a schematic illustration of a two cycle internal combustion engine.
Figure 2:
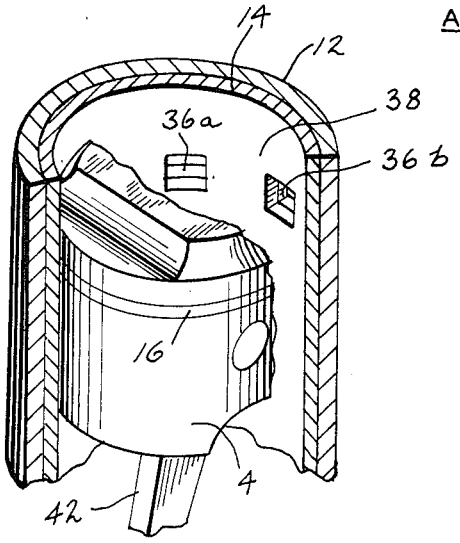
FIG. 2 is a perspective view of a portion of the engine of FIG. 1.
Figure 3:
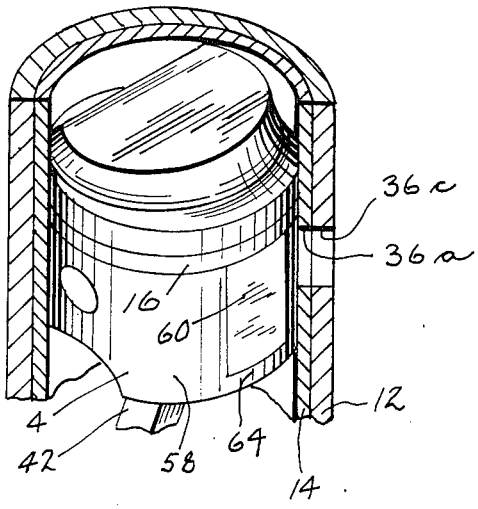
FIG. 3 is a perspective view of a portion of an engine constructed in accordance with the invention.

FIG. 1 shows one cylinder of a two cycle crankcase compression internal combustion engine 2. A piston 4 is reciprocal in a cylinder 6 between a crankcase 8 and a combustion chamber 10. The cylinder is formed by a cylinder block 12 having a cylinder liner 14. Piston 4 has one or more rings 16 engaging cylinder liner 14. A carburetor 16 supplies fuel and air as controlled by throttle valve 18 into crankcase 8 through one-way reed valve 20. The carburetor includes a float bowl 22 with a float 24 having a lever 26 pivoted at 28 to open and close valve 30 to admit or block fuel from the fuel pump, as is conventional. Combustion chamber 10 includes a fuel-air inlet port 32. A fuel-air transfer passage 34 extends between crankcase 8 and fuel-air inlet port 32. Combustion chamber 10 includes exhaust port means 36 provided by a pair of openings 36*a* and 36*b*, FIG. 2, through cylinder liner 14 aligned with a second pair of openings 36*c* and 36*d*, FIG. 5, through cylinder block 12. Exhaust bridge means is provided by an exhaust bridge 38 between and bridging openings 36*a* and 36*b*, and an exhaust bridge 39 between and bridging openings 36*c* and 36*d*. Piston 4 is connected to crankshaft 40 by connecting rod 42.

In operation, piston 4 has a charging stroke in the upward axial direction as shown at arrow 44 compressing fuel-air mixture in combustion chamber 10 and creating a vacuum in crankcase 8. Piston 4 has a power stroke upon combustion of the mixture by spark plug 46 driving piston 4 downwardly in the opposite axial direction pressurizing crankcase 8 and forcing fuel-air mixture to flow from crankcase 8 through transfer passage 34 to fuel-air inlet port 32 in combustion chamber 10 for repetition of the cycle. The spent combustion products are exhausted through exhaust port 36.

Figure 4:
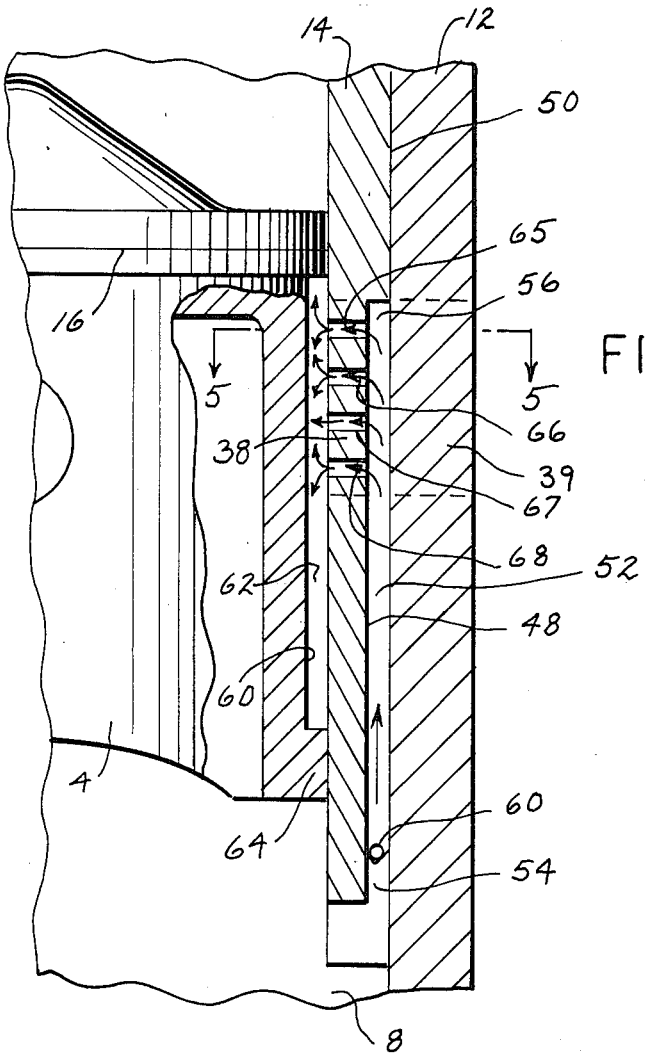
FIG. 4 is a sectional view of a portion of the structure in FIG. 3.
Figure 5:
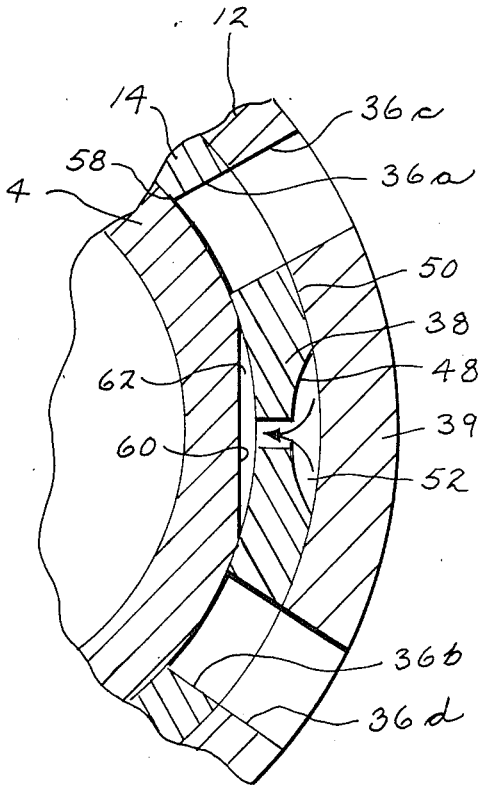
FIG. 5 is a sectional view taken along line 5—5 of FIG. 4.

Cylinder liner 14 has an axially extending portion 48, FIG. 4, along its outer surface 50 at exhaust bridges 38 and 39 and spaced from cylinder block 12 by a gap 52 defining an axially extending flow passage communicating at its bottom axial end 54 with crankcase 8 and at its top axial end 56 with exhaust bridges 38 and 39. Gap 52 provides a fuel-air flow passage from crankcase 8 to exhaust bridges 38 and 39 along the interface between cylinder liner 14 and cylinder block 12. During the downward power stroke of piston 4, fuel-air mixture in crankcase 8 is forced upwardly through axially extending flow passage gap 52 to cool and lubricate exhaust bridge 38 and cool exhaust bridge 39. Flow passage gap 52 is preferably provided by an axially extending slot 48 in the outer surface of cylinder liner 14. Alternatively, flow passage gap 52 may be provided by an axially extending slot in cylinder block 12. As seen in FIG. 5, flow passage gap 52 extends axially along and between and communicates with exhaust bridges 38 and 39. Flow passage gap 52 does not communicate with openings 36*a* and 36*b*, nor with openings 36*c* and 36*d*.

Piston 4 has a cylindrical outer side wall 58 of given radius closely adjacent cylinder liner 14 except for a relieved surface portion 60 extending axially therealong and facing exhaust bridge 38 and spaced from cylinder liner 14 by a gap 62 defining a second axially extending flow passage. Flow passage gap 62 has a top axial end closed by piston rings 16, and has a lower axial end closed by a lower skirt portion 64 of the piston side wall which is not relieved and which has the noted given radius and is closely adjacent cylinder liner 14. Surface 60 is preferably machined flat.

Exhaust bridge 38 of cylinder liner 14 has a plurality of apertures 65, 66, 67 and 68 drilled radially therethrough communicating between flow passage gaps 52 and 62. During the power stroke of the piston, fuel-air mixture in crankcase 8 is forced through flow passage gap 52 between cylinder liner 14 and cylinder block 12 and through apertures 65–68 of exhaust bridge 38 and into flow passage gap 62 between piston 4 and cylinder liner 14. This flow through exhaust bridge 38 improves cooling and lubrication of the latter. The flow leaks back into crankcase 8 along the interface between cylinder liner 14 and piston side wall 58 including lower portion 64. It is also preferred that a one-way check valve 60 be provided in flow passage gap 52 permitting fuel-air mixture flow from crankcase 8 through flow passage gap 52 to exhaust bridges 38 and 39, and blocking reverse fuel-air mixture flow from exhaust bridges 38, 39 through flow passage gap 52 to crankcase 8.

It is recognized that various equivalents, alternatives and modifications are possible within the scope of the appended claims.

I claim:

1. A two cycle internal combustion engine comprising:

a piston reciprocal in a cylinder between a crankcase and a combustion chamber, said cylinder comprising a cylinder block having a cylinder liner, said piston having one or more piston rings engaging said cylinder liner;

means for supplying fuel and air to said crankcase;

fuel-air inlet port means in said combustion chamber;

fuel-air transfer passage means between said crankcase and said fuel-air inlet port means in said combustion chamber;

exhaust port means in said combustion chamber, and exhaust bridge means in said exhaust port means preventing expansion of said piston rings into said exhaust port means;

said piston having a charging stroke in one axial direction compressing fuel-air mixture in said combustion chamber and creating a vacuum in said crankcase, and having a power stroke upon combustion of said mixture driving said piston in the opposite axial direction pressurizing said crankcase and forcing fuel-air mixture to flow from said crankcase through said transfer passage means to said fuel-air inlet port means in said combustion chamber for repetition of the cycle, the spent combustion products being exhausted through said exhaust port means;

means providing a fuel-air flow passage from said crankcase to said exhaust bridge means along the interface between said cylinder liner and said cylinder block.

2. The invention according to claim 1 wherein said exhaust bridge means comprises one or more apertures through said cylinder liner communicating with said fuel-air flow passage, and comprising means providing a second fuel-air flow passage between said piston and said cylinder liner and in communication with said one or more apertures to facilitate fuel-air mixture flow through said exhaust bridge means to improve lubrication and cooling of the latter.

3. A two cycle internal combustion engine comprising:

a piston reciprocal in a cylinder between a crankcase and a combustion chamber, said cylinder comprising a cylinder block having a cylinder liner, said piston having one or more piston rings engaging said cylinder liner;

means for supplying fuel and air to said crankcase;

fuel-air inlet port means in said combustion chamber;

fuel-air transfer passage means between said crankcase and said fuel-air inlet port means in said combustion chamber;

exhaust port means in said combustion chamber, and exhaust bridge means in said exhaust port means preventing expansion of said piston rings into said exhaust port means;

said piston having a charging stroke in one axial direction compressing fuel-air mixture in said combustion chamber and creating a vacuum in said crankcase, and having a power stroke upon combustion of said mixture driving said piston in the opposite axial direction pressurizing said crankcase and forcing fuel-air mixture to flow from said crankcase through said transfer passage means to said fuel-air inlet port means in said combustion chamber for repetition of the cycle, the spent combustion products being exhausted through said exhaust port means;

said cylinder liner having an axially extending portion along its outer surface at said exhaust bridge means and spaced from said cylinder block by a gap defining an axially extending flow passage communicating at one axial end with said crankcase and at the other axial end with said exhaust bridge means, such that during said power stroke, fuel-air mixture in said crankcase is forced through said axially extending flow passage gap to cool and lubricate said exhaust bridge means.

4. The invention according to claim 3 wherein said exhaust port means comprises a first pair of openings in said cylinder liner aligned with a second pair of openings in said cylinder block, and wherein said exhaust bridge means comprises a first bridge between and bridging said first pair of openings, and a second bridge between and bridging said second pair of openings, and wherein said flow passage gap extends axially along and between and communicates with said first and second bridges, and wherein said flow passage gap does not communicate with said first pair of openings and does not communicate with said second pair of openings, said piston having an axially extending portion along its outer side wall facing said second exhaust bridge and spaced from said cylinder liner by a gap defining a second axially extending flow passage, said second exhaust bridge having one or more apertures therethrough communicating between said first and second axially extending flow passage gaps, such that during said power stroke, fuel-air mixture in said crankcase is forced through said first flow passage gap between said cylinder liner and said cylinder block and through said one or more apertures through said first exhaust bridge and into said second flow passage gap.

5. The invention according to claim 4 wherein said first flow passage gap is formed by an axially extending slot in the outer surface of said cylinder liner.

6. The invention according to claim 4 wherein said first flow passage gap is formed by an axially extending slot in said cylinder block.

7. The invention according to claim 4 comprising one-way valve means in said first flow passage gap permitting fuel-air mixture flow from said crankcase through said first flow passage gap to said exhaust bridge means, and blocking reverse fuel-air mixture flow from said exhaust bridge means through said first flow passage gap to said crankcase.

8. The invention according to claim 4 wherein said second flow passage gap is formed by said axially extending portion of said piston along its outer side wall recessed away from said cylinder liner.

9. The invention according to claim 4 wherein said piston has a cylindrical outer side wall of given radius closely adjacent said cylinder liner except for a relieved surface on said piston outer side wall extending axially therealong and facing said first exhaust bridge and spaced from said cylinder liner and defining said second flow passage gap.

10. The invention according to claim 9 wherein said second flow passage gap has one axial end closed by said one or more piston rings engaging said cylinder liner, and has the other axial end closed by a portion of said piston side wall which is not relieved and which has said given radius.

11. The invention according to claim 10 wherein said relieved surface is flat.

12. The invention according to claim 4 wherein:

said first flow passage gap is formed by an axially extending slot in the outer surface of said cylinder liner;

said piston has a cylinder outer side wall of given radius closely adjacent said cylinder liner except for a relieved surface on said piston outer side wall extending axially therealong and facing said exhaust bridge portion of said cylinder liner and spaced from said cylinder liner and defining said second flow passage gap;

said second flow passage gap has one axial end closed by said one or more piston rings engaging said cylinder liner, and has the other axial end closed by a portion of said piston side wall which is not relieved and which has said given radius.

* * * * *